US006378140B1

(12) United States Patent
Abraham et al.

(10) Patent No.: US 6,378,140 B1
(45) Date of Patent: Apr. 30, 2002

(54) IMPACT AND ENERGY ABSORBING PRODUCT FOR HELMETS AND PROTECTIVE GEAR

(76) Inventors: Carl J. Abraham, 3 Baker Hill Rd., Great Neck, NY (US) 11023; Henry D. Cross, 546 Old Field Rd., Murrells Inlet, SC (US) 29576

( * ) Notice: Subject to any disclaimer, the term of this patent is extended or adjusted under 35 U.S.C. 154(b) by 0 days.

(21) Appl. No.: 09/949,237

(22) Filed: Sep. 7, 2001

(51) Int. Cl.[7] ..... A42B 3/00; A41D 27/26

(52) U.S. Cl. ..... 2/411; 2/425; 2/459; 2/463; 2/465; 2/467

(58) Field of Search ..... 2/411, 459, 463, 2/464, 465, 467, 6.8, 416, 422, 425, 22, 24

(56) References Cited

U.S. PATENT DOCUMENTS

| | | | | | |
|---|---|---|---|---|---|
| 573,919 | A | * | 12/1896 | Rice | 2/24 |
| 1,251,537 | A | * | 1/1918 | Kempny | 2/411 |
| 1,753,055 | A | * | 4/1930 | Matheson | 2/24 |
| 3,237,201 | A | * | 3/1966 | Morgan | 2/414 |
| 3,735,418 | A | * | 5/1973 | Kavanagh et al. | 2/416 |
| 4,213,202 | A | * | 7/1980 | Larry | 2/456 |
| 4,223,409 | A | | 9/1980 | Lee | |
| 4,590,621 | A | | 5/1986 | Flosi | |
| 4,642,814 | A | | 2/1987 | Godfrey | |
| 4,768,500 | A | | 9/1988 | Mason | |
| 5,204,998 | A | * | 4/1993 | Liu | 2/411 |
| 5,283,914 | A | | 2/1994 | James | |
| 5,444,870 | A | | 8/1995 | Pinsen | |
| 5,517,699 | A | | 5/1996 | Abraham | |
| 5,746,442 | A | | 5/1998 | Hoyaukin | |
| 5,794,270 | A | | 8/1998 | Howat | |
| 5,956,777 | A | | 9/1999 | Popovich | |

* cited by examiner

*Primary Examiner*—Rodney M. Lindsey

(57) ABSTRACT

An impact and energy absorbing product for helmets and protective gear. More particularly, the invention teaches the usage of coiled springs in conjunction with polymeric materials or metals such as titanium, to absorb and dissipate forces of humans and other objects coming in contact with helmets and a variety of sporting equipment. Depending upon the exact environment in which the same are to be used, the coiled springs may be constructed of polymers or titanium—lightweight, yet durable materials to accomplish the purposes of the invention. In the preferred mode of attachment, an insert is fitted to each end of each spring, with a flared insert then placed into a molded female slot upon the equipment to hold the spring in place. Thus, a helmet, chest protector or the like may comprise a series of female slots such that multiple springs can easily slide therein.

18 Claims, 4 Drawing Sheets

Fig. 1

IMPACT AND ENERGY ABSORBING PRODUCT FOR HELMETS AND PROTECTIVE GEAR

BACKGROUND OF THE INVENTION

1. Field of the Invention

The present invention is an impact and energy absorbing product for helmets and protective gear. More particularly, the invention teaches the usage of coiled springs in conjunction with polymeric materials or metals such as titanium, to absorb and dissipate forces of humans and other objects coming in contact with helmets and a variety of sporting equipment.

2. Description of the Prior Art

Numerous innovations for helmet devices have been provided in the prior art that are described as follows. Even though these innovations may be suitable for the specific individual purposes to which they address, they differ from the present invention as hereinafter contrasted. The following is a summary of those prior art patents most relevant to the invention at hand, as well a description outlining the differences between the features of the present invention and those of the prior art.

1. U.S. Pat. No. 5,444,870, invented by Pinsen, entitled "Football Helmet And Shoulder Pad Combination"

The patent to Pinsen describes a football helmet and shoulder pad combination designed to prevent head and neck injuries. An outer helmet is connected to a neck assembly which permits but limits head turning mobility as well as up-down and left and right head tilt. The neck mechanism which is mounted about the neck comprises substantially circular inner and outer spherical guides and a concentric movable inner element therebetween with an upwardly extending member on each side of the neck. The guides contain stops to limit the motion permitted by the helmet and the lower portion of the mechanism is mounted on the shoulder pads to distribute the load during impact. The helmet portion with a resilient coupling joining the portions. The upwardly extending members on the inner element are mounted to respective sides of the outer helmet. The helmet may also be retrofitted to existing equipment.

2. U.S. Pat. No. 5,956,777, invented by Popovich, entitled "Helmet"

The Popovich invention describes a helmet assembly for protecting a head and neck by laterally displacing impact forces. The helmet assembly has a helmet and a face guard. The helmet has a rigid inner shell, a resilient spacing layer outside of and in contact with the inner shell, an articulated shell having a plurality of discrete rigid segments disposed outside of and in contact with the resilient spacing layer, and a resilient outer shell made of foam covered by an flexible protective layer. The face guard has a plurality of transverse bars with a longitudinal bar down the center. The face guard has shock absorbers integrated on the lowermost transverse bar.

3. U.S. Pat. No. 4,223,409, invented by Lee, entitled "Helmet Provided With Shockproof And Ventilative Device"

The Lee invention relates to a helmet provided with shockproof and ventilative devices, the helmet being encircled with a plurality of plastic strips along its outer wall, and a plurality of corresponding plastic or rubber tubes along its inner wall, the upper portion of the helmet being filled with sponge material, thereby to give a wearer protection against shock.

4. U.S. Pat. No. 5,746,442, invented by Hoyaukin, entitled "Safety Apparel"

The patent to Hoyaukin describes safety apparel, particularly for motorcyclists, equestrians and other unprotected persons which comprises inflatable, shock-absorbing pads. Inflation of the pads is effected with the aid of a gas-delivering arrangement which includes a container sealed by a sealing plate and which contains compressed or liquefied gas, a small explosive charge, means for detonating the charge in the event of an accident, and a device activated by the explosive charge to penetrate the sealing plate. The explosive charge is intended to be detonated by means of a striking pin operated by a spring. Means are arranged for storing the energy required in the spring as a result of a relative motion between the wearer of the apparel and a motorcycle, horse or the like.

5. U.S. Pat. No. 5,517,699, invented by Abraham, II, entitled "Devices For Preventing Cervical Spine Injuries In Contact Sports"

In the patent to Abraham, II, helmet accessory devices are provided for protecting a wearer from cervical spine injuries. The devices comprise a shoulder assembly to which at least one leaf spring has its first end rigidly connected. A post is formed on the leaf spring to carry a hood superposed above a helmet worn by the wearer. Axially compressive forces sustained by the hood are opposed by the post and the shoulder assembly.

6. U.S. Pat. No. 5,283,914, invented by James, entitled "Protective Helmets"

The patent to James describes a protective helmet which incorporates a visor retractable therewithin, a fan for providing filtered airflow through a duct within the shell to the visor, and ear defenders mounted substantially within the profile of the shell.

7. U.S. Pat. No. 4,590,621, invented by Flosi et al., entitled "Chest Protector"

In the patent to Flosi et al., an upper body chest protector is provided for use particularly in off-road motorcycle and bicycle racing which features spring-biased epaulets, so that as the upper arm is raised, the respective epaulet will be raised against the spring bias to permit movement of the upper arm, but upon lowering of the arm, the epaulet is forced down into its lowered position to assure that the shoulder will be protected thereby after the upper arm is lowered.

8. U.S. Pat. No. 5,794,270, invented by Howat, entitled "Protective Headwear"

The patent to Howat describes protective headwear comprising: a first head covering for covering at least one portion of a person's head; a second head covering for covering at least one portion of the person's head, at least one portion of said second head covering being within, or adapted to be at least partly within said first head covering, such that the first and second head coverings are in a joint relationship whereby the second head covering is movable relative to the first head covering.

9. U.S. Pat. No. 4,642,814, invented by Godfrey, entitled "Athletic Padding"

The Godfrey invention is an improved padding used by athletes and others to prevent or greatly reduce the instances of injury due to blows to the body and its appendages, particularly to the more boney parts thereof such as knees, elbow, shoulders, thighs, hips, and the like. This is accomplished through the utilization of non-metallic spring means encapsulated in a vinyl type material with air pockets formed therebetween with cross-stress means for additional protection.

10. U.S. Pat. No. 4,768,500, invented by Mason et al., entitled "Knee Protector"

In the patent to Mason et al., an athletic knee protector is disclosed wherein a bowed leaf spring hinge structure is supported on load distribution pads or cuffs attached to the thigh and shin of the wearer and is spaced laterally from the lateral side of the knee to protect the knee of an athlete against injury from lateral forces and impacts such as are likely to occur in football. The bowed leaf spring hinge structure absorbs such forces and impacts and redistributes them at locations spaced substantially above and below the knee proximate the strong bones of the leg. Preloading of knee ligaments in the lateral/medial direction is avoided, and lateral forces and impacts are better distributed, by connecting the pads or cuffs to the hinge structure with a free rocking or pivoting action in the lateral/medial direction. Also, the pads or cuffs are made more adaptable to the curvature of the leg by a variable flexibility in the anterior/posterior direction so that attachment and working loads applied to the leg are spread out more uniformly.

The aforementioned prior art patents illustrate various enhanced equipment designs, including: shock absorbers for face masks of helmets; sponge materials in combination with plastic or rubber tubing within helmets; padding that may be tailored to particular activities through usage of inflatable materials; and usage of leaf springs in equipment to prevent spinal injuries in particular.

It is suggested that the closest prior art lies in the inventions to Pinsen and Godfrey. Pinsen discloses an outer helmet portion and inner helmet portion positioned over the wearer's head, with resilient springs separating and joining the inner and outer portions. Such also includes a neck assembly coupled to the helmet portion, to restrict movement in any direction to prevent injury, wherein forces are further directed to shoulder pads to better distribute any impact. Thus, forces applied to the top of the head are dissipated through the neck mechanism to shoulder pads, unlike the present invention.

Godfrey discloses an assembly which relies upon shock-absorbing springs and air pockets within pads. The outer layer of a spring pad is composed of a flexible sheet with an inner flexible sheet spaced with rows of styrene butadine springs. As the springs expand to their relaxed position, they provide space for cushions of air to form. Upon impact, the springs compress to absorb the shock of the blow while the air pockets cushion the blow. Thus, the Godfrey device relies upon synthetic rubber as the primary spring material, not lightweight polymers or metals such as titanium.

Unlike the above, the present invention comprises coiled springs manufactured of polymeric materials or titanium, which absorb and dissipate forces coming in contact with a variety of helmets or sporting equipment. An insert is fitted to each end of the spring, with a flared insert placed into a molded female slot upon the equipment. The springs are spread throughout the desired area and the stiffness of the springs may be tailored according to the level of strength needed for each sport or activity. Thus, the invention reduces the occurrence of serious injury in many sports and activities, and does so in a more cost-effective manner, due to the polymer or titanium material utilized.

SUMMARY OF THE INVENTION

As noted, the present invention is an impact and energy absorbing product for helmets and protective gear. More particularly, the invention teaches the usage of coiled springs in conjunction with polymeric materials or metals such as titanium, to absorb and dissipate forces of humans and other objects coming in contact with helmets and a variety of sporting equipment.

Depending upon the exact environment in which the same are to be used, the coiled springs may be constructed of polymers or titanium—lightweight, yet durable materials to accomplish the purposes of the invention. In the preferred mode of attachment, an insert is fitted to each end of each spring, with a flared insert then placed into a molded female slot upon the equipment to hold the spring in place. Thus, a helmet, chest protector or the like may comprise a series of female slots such that multiple-springs can easily slide therein. The springs may be spread throughout the area to be protected, providing a completely controlled protected area to effectively absorb and dissipate forces upon impact.

Importantly, the stiffness of the springs of the invention may be tailored to an appropriate degree according to the type of activity in which the invention is utilized. In total, the present invention lessens the incidence and severity of injury in a great variety of sporting activities, at low costs and with ease of manufacture and installation.

To illustrate the need for the present invention, the following description relates to the incidence and severity of concussions commonly occurring in a host of sporting activities: About 300,000 sports-related concussions occur each year, with 100,000 occurring in the sport of American-style football alone. In addition, approximately 900 sports-related traumatic brain-injury deaths occur each year, and the risk of concussion is approximately 4 to 6 times higher in persons who have experienced previous concussions.

To further illustrate the current problem, the incidence of concussion per 100,00 games or practices at the college level, by sport, are as follows: football-27; ice hockey-25; men's soccer-25; women's soccer-24; wrestling-20; women's basketball-15; and men's basketball-12. A significant number of head injuries is added to the above when activities such as roller blading, roller skating and roller hockey, scooters, motorcycling, and boxing are included.

A concussion is a change in mental status caused by a blow to the head. Symptoms include confusion, amnesia, nausea, dizziness, blurred vision, and loss of consciousness. Such is due to the fact that at the moment of injury, the brain becomes chemically imbalanced. The list of athletes who have sustained career-ending concussions spans every major sport and activity. Although football and hockey are widely considered the most inherently dangerous, no sporting activity is completely safe.

Furthermore, younger athletes are at considerable risk as well. Although the level of play and corresponding collisions are less than those in adult sports, younger players are far less adept at protecting themselves, leading to multiple sever injuries. For the purposes of example, 46% of injuries among children and adolescents in the sport of ice hockey relate to head injuries in particular.

Based upon all of the foregoing, a need exists for protective headgear that will mitigate the incidence of head trauma and concussion. So as to render the same available to the most athletes possible, a need exists for such an apparatus to be manufactured at a relatively low cost. Furthermore, there is a need for such improved headgear to be adapted to helmets of all major sports and recreational activities, as well as additional activities requiring the usage of protective head gear such as construction helmets, hard hats, police and military head gear, and other fields and applications.

As noted above, then, the present invention is an improved protective device which relies upon a unique coiled spring assembly. More particularly, the present invention is an improved protective device for sporting activities, such as football, hockey, cycling, and the like, and for construction helmets, hard hats, police and firefighter head gear, and military head gear, that is specifically designed to improve the absorption and dissipation of primary forces directly into the shell of the helmet.

It is therefore the primary objective of the present invention to mitigate the incidence of concussion and severe injury to the user. Accordingly, the spring assembly may be applied to specific areas of equipment, such as the critical or vulnerable portions of a user's head. Such critical or vulnerable locations are: (1) each side of the helmet, at the ear and above the ear; (2) the front of the helmet, between and above the eyes; (3) the rear or occipital area; and (4) the top or crown of the dome. Importantly, in any such placement, the coiled springs of the present invention function to receive primary forces, with the equipment itself receiving secondary forces, existing interior padding receiving additional forces, and only the remaining dissipated forces being distributed to the user.

As such, usage of the present invention adds minimal weight to the helmet or protective gear. In addition, the invention functions to protect the shell from fractures or cracks, providing additional benefits to the user. Finally, the invention allows for increased safety and protection in a very inexpensive manner, one that can be manufactured and distributed with relative ease.

In summation, in light of the foregoing, it is an object of the present invention to provide an impact and energy absorbing assembly that is lightweight and relatively inexpensive to manufacture.

It is a further object to provide a coiled spring assembly that may be easily retrofitted to previously-existing helmets and protective gear, providing the benefits of the present invention to all users thereof.

In addition, it is an object of the present invention to provide a coiled spring assembly that may alternatively be manufactured on new protective gear for users who desire the benefits thereof.

It is a further object of the invention to provide a coiled spring assembly that serves the secondary purpose of mitigating injury to other persons that come in contact with the protective gear during the course of sporting activity and other hazardous activity.

It is a further aim of the invention to provide a coiled spring assembly that conveniently attaches to a headgear apparatus without expensive modification to the helmet or equipment, thus reducing the cost of manufacture.

In addition, it is an object of the invention to provide a coiled spring assembly that protects the most vulnerable areas of the head, due to its unique ability to fit the contours of the head, functioning to significantly reduce the incidence of concussion to the user, thus prolonging the user's playing career.

It is a further object of the present invention to provide a coiled spring assembly that mitigates the incidence of cracking or fractures to the shell of the helmet or protective equipment.

It is also an object of the invention to provide a coiled spring assembly for the exterior of a helmet, dispensing with any need to add any interior pads to the standard helmet.

It is a further object of the invention to provide a coiled spring assembly that is manufactured in a variety of previously determined sizes, so as to render the same effective for a host of sporting activities and additional applications where such protection is desired.

Finally, it is an object of the invention to provide a coiled spring assembly that is manufactured in a variety of previously determined colors and designs, so as to match the decor of the helmet upon which the same are utilized.

The novel features which are considered characteristic for the invention are set forth in the appended claims. The invention itself, however, both as to its construction and its method of operation, together with additional objects and advantages thereof, will be best understood from the following description of the embodiments when read and understood in connection with accompanying drawings.

BRIEF DESCRIPTION OF PREFERRED EMBODIMENTS

DETAILED DESCRIPTION OF THE PREFERRED EMBODIMENT

Figure 1:
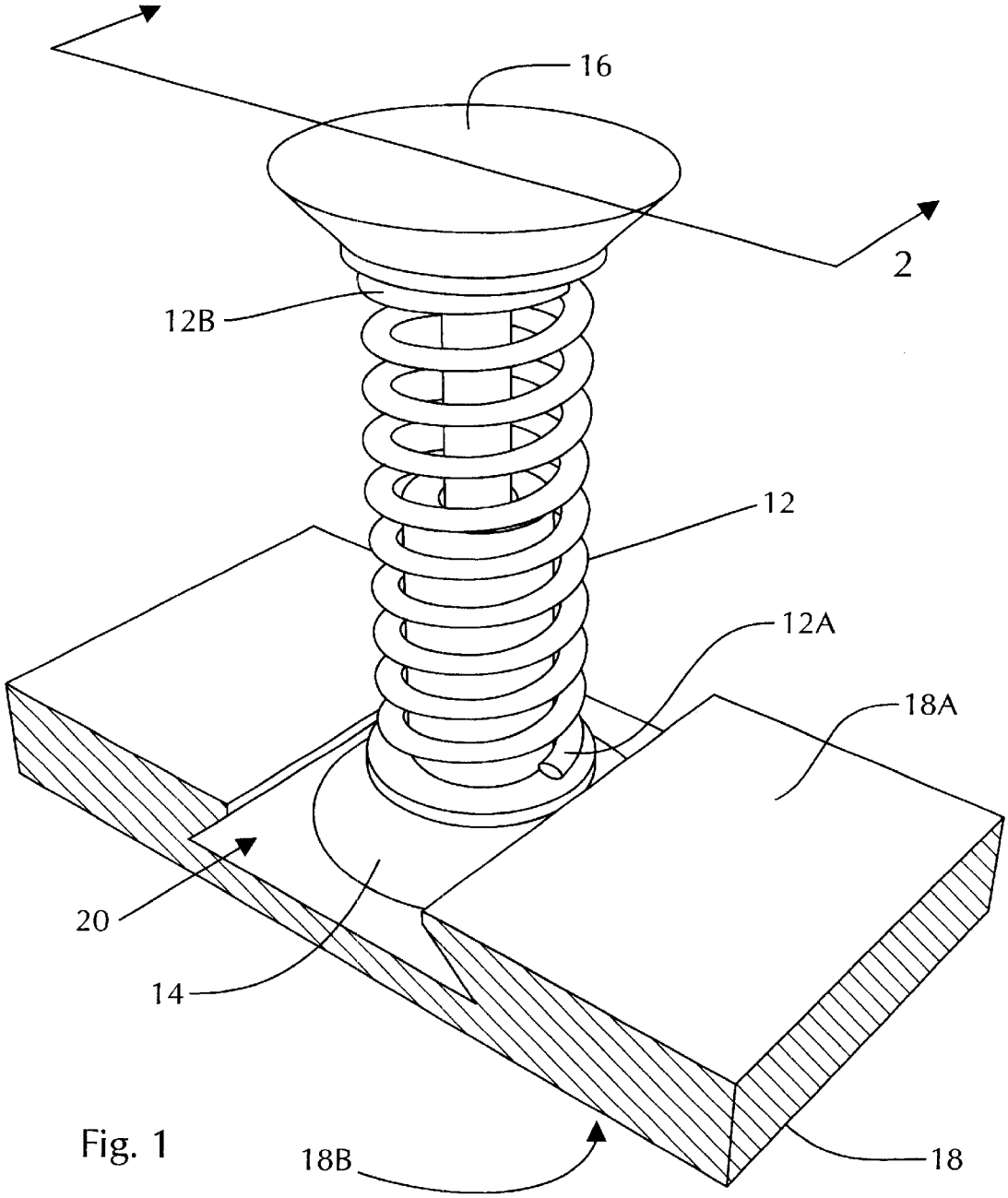
FIG. 1 is a front three-quarter perspective view of the spring mechanism of the present invention, illustrating the principal design in the preferred mode, including flared insert within female receiving member.
Figure 2:
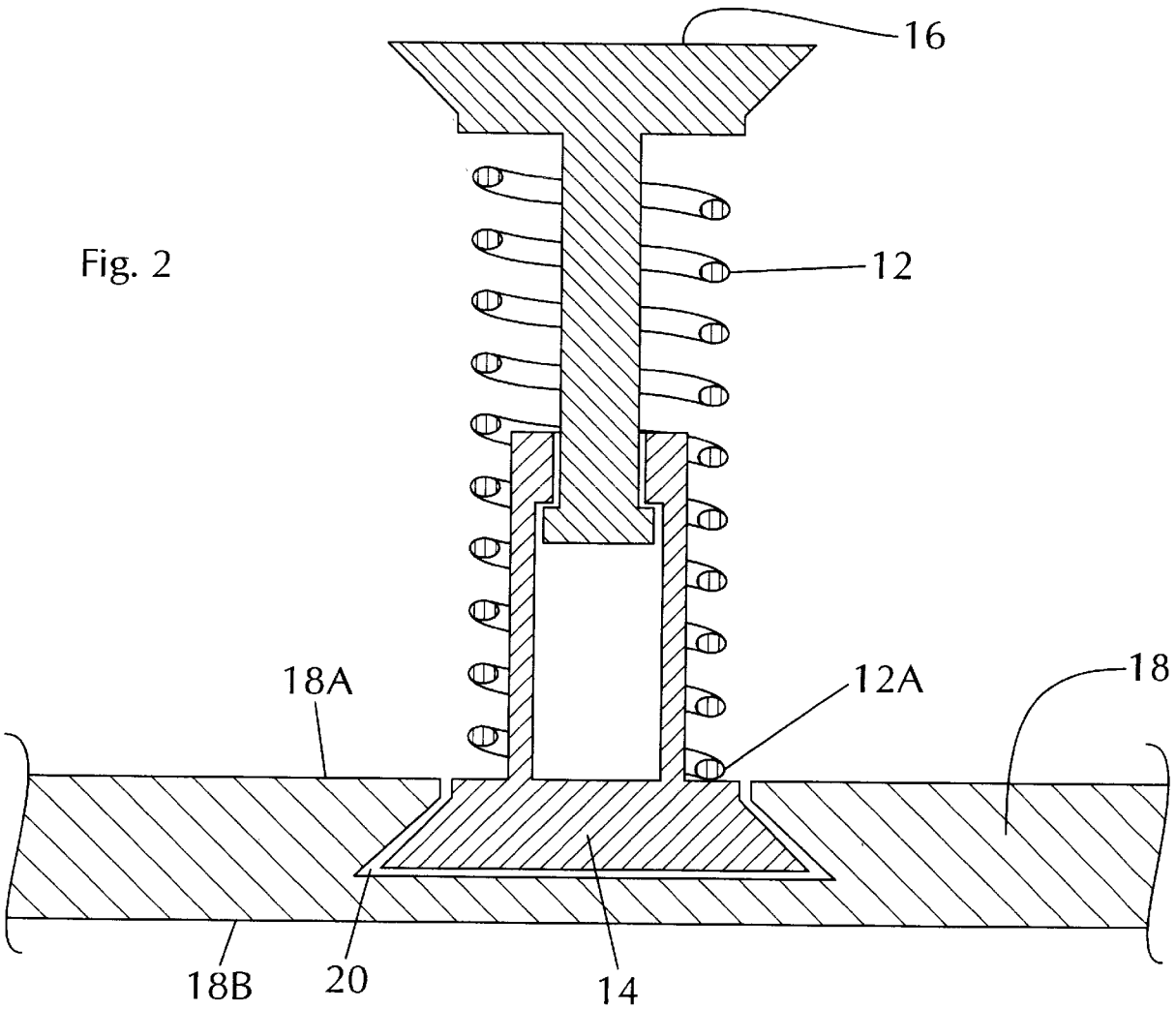
FIG. 2 is a cross-sectional view of the spring mechanism of the present invention along Line "2" of FIG. 1, also illustrating the principal design in the preferred mode, including flared insert within female receiving member.
Figure 3:
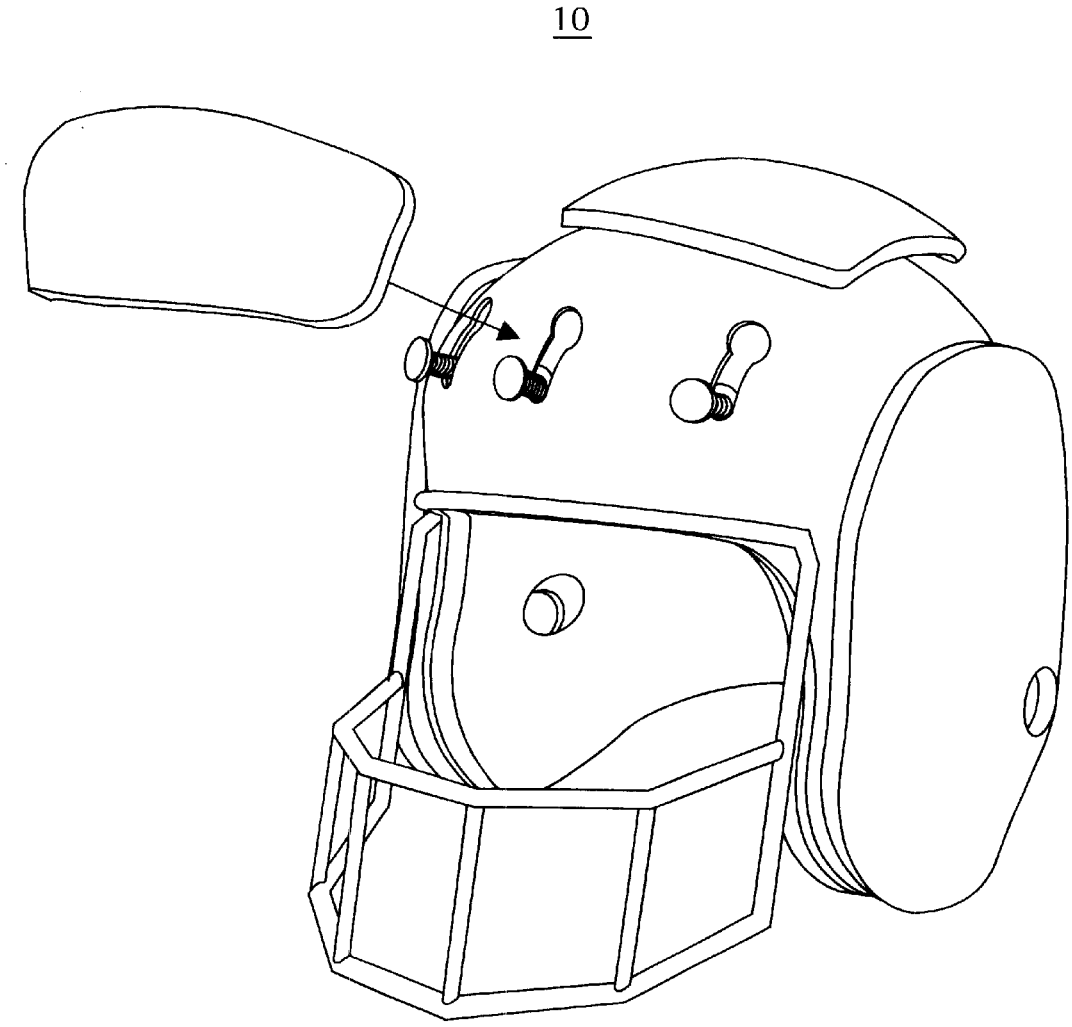
FIG. 3 is a front three-quarter perspective view of the spring mechanism of the present invention, as embodied within a football-style helmet for the purposes of example only. Three spring members are illustrated to denote the general structure of the present invention, and a greater quantity of spring members may be utilized, if desired.
Figure 4:
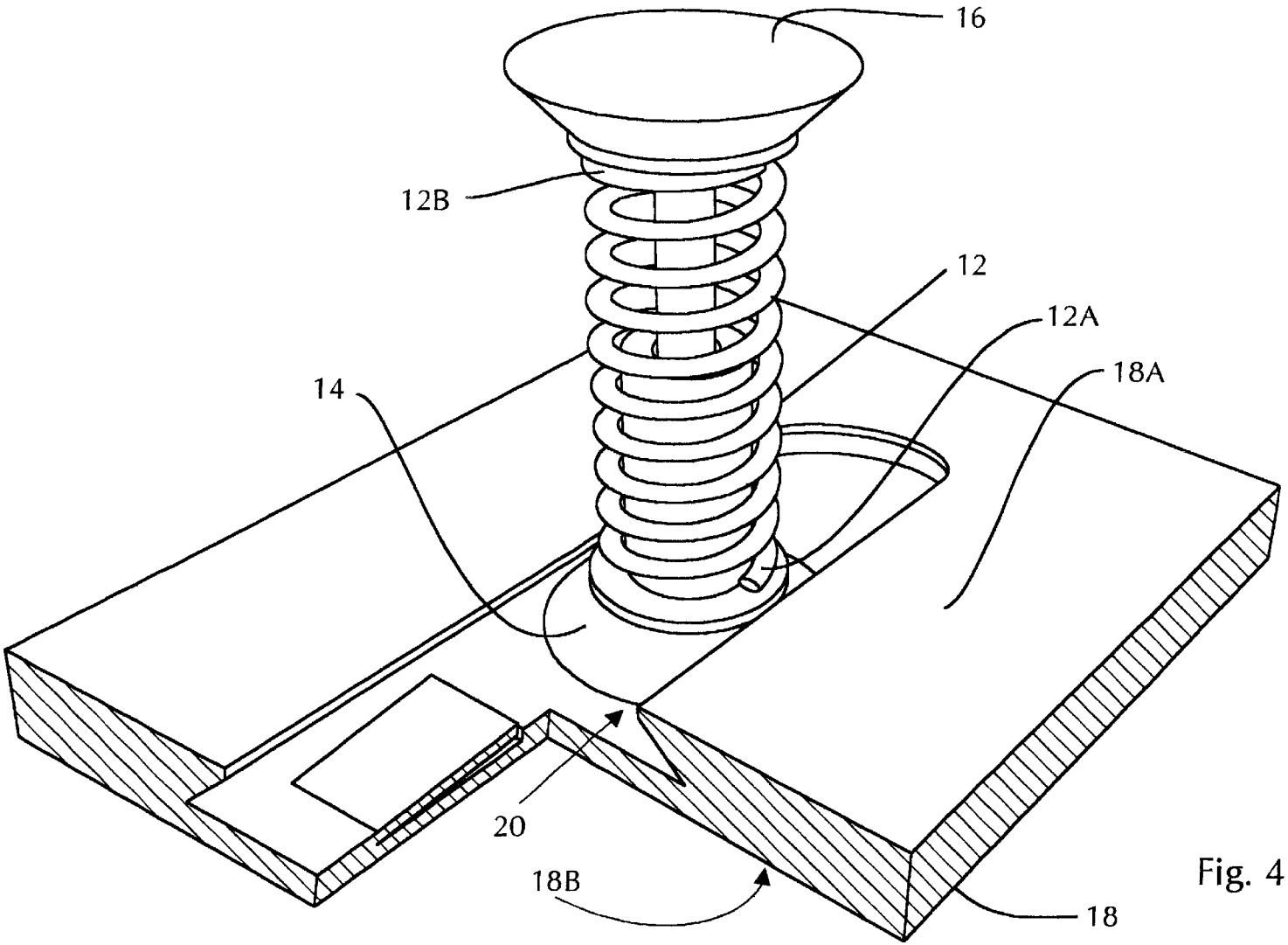
FIG. 4 is a front three-quarter perspective view of the spring mechanism of the present invention, illustrating the principal design as depicted in FIG. 1, and also depicting a simple locking mechanism for the purposes of example only.

This description relates to the general comments above, as well as FIG. 1, which is a front three-quarter perspective view of the spring mechanism of the present invention, illustrating the principal design in the preferred mode, including flared insert within female receiving member; FIG. 2, which is a cross-sectional view of the spring mechanism of the present invention along Line "2" of FIG. 1, also illustrating the principal design in the preferred mode, including flared insert within female receiving member; FIG. 3, which is a front three-quarter perspective view of the spring mechanism of the present invention, as embodied within a football-style helmet for the purposes of example only; and FIG. 4, which is a front three-quarter perspective view of the spring mechanism of the present invention, illustrating the principal design as depicted in FIG. 1, and also depicting a simple locking mechanism for the purposes of example only.

In regards to both FIGS, the spring assembly for usage in connection with protective equipment comprises a previously-determined quantity of springs, such quantity selected according to the needs of any of a host of particular applications, for example, whether the same are to be applied to a helmet, shin guard, or chest protector. As depicted in the FIGS, each spring (12), comprises a spring first end (12A) or bottom portion, and a spring second end (12B) or upper portion.

Importantly, a first flared insert (14) is affixed to each spring (12) at the spring first end (12A), by a means selected according to ease of manufacture and general durability.

The flared insert (14) generally conical in configuration, tapered such that an outer edge of the first flared insert (14) is of a greater diameter than an inner edge of the first flared insert (14) which comes in contact with the spring first end (12A). Each such edge is generally cylindrical, forming a stable base for the flared insert member (14).

Likewise, a second flared insert (16) may be affixed to each spring (12) at the spring second end (12B). The second flared insert (16) is also generally conical in configuration, and also tapered such that an outer edge of the second flared insert (16) is of a greater diameter than an inner edge of the second flared insert (16) which comes in contact with the spring second end (12B). As is the case in the above description, each such edge is generally cylindrical, forming a stable base for the flared insert member (16).

Next, a receiving member (18) embodied within the protective equipment in question itself comprises a top surface (18A), bottom surface (18B), and molded female slot (20). The molded female slot (20) is importantly in the form of a tapered, generally conical aperture, functioning to slidingly receive the first flared insert (14) therein.

The receiving member (18) rigidly affixed to a previously-determined item of protective equipment. The second flared insert (16) may also be slidingly received by a solid member, which will form the outermost surface in which direct forces come in contact. This configuration functions to allow the coiled spring to receive primary forces, with the item of protective equipment receiving secondary forces, previously existing protective equipment padding receiving additional forces, with only remaining dissipated forces distributed to a user's body.

In preferred modes of manufacture the spring members are produced in a thickness of a range of one-sixteenth inch to three-quarter inch. However, other thicknesses of springs may be utilized if desirable.

In all such cases, the springs are manufactured in a variety of previously-determined sizes, functioning to render the springs effective for multiple previously-determined sporting events and hazardous activities. Thus, the apparatus may be utilized for activities such as football, hockey, baseball, cycling, climbing, skateboarding, roller skating, or any other hazardous activity requiring usage of a protective helmet such as construction, military usage, and police and fire-fighting usage.

Moreover, the springs may be manufactured in a variety of previously determined colors and designs. Thus, such will function to match a decor of a helmet upon which the springs are utilized, rendering the same even more desirable to the user.

In all embodiments, as noted, the springs attach to the hard shell without expensive modification to the hard shell. In fact, it should be noted that the springs mitigate the incidence of cracking to the hard shell itself, preserving and prolonging the life of the helmet to the benefit of its owner.

It is imperative to note that the springs of the present invention may be tailored to absorb and dissipate foreseeable forces of humans and objects coming in contact with the spring assembly and protective equipment. As such, the present invention provides an assembly previously unavailable to those engaging in sporting and dangerous activities, as the coiled springs allow for far greater adaptability to particular needs than traditional pads constructed of foam and the like.

Regarding the precise construction of the present invention, the springs may be manufactured of polymeric materials, such as a durable plastic to provide strength for the assembly at inexpensive cost of manufacture. Alternatively, the springs the springs may be manufactured of metal materials, if desired by the manufacturer. Importantly, the spring may be manufactured of titanium, providing the utmost in durability at sharply reduced weight and costs.

In one embodiment, the flared insert of each spring is removably attached to the spring. However, in an alternate embodiment, the flared insert is rigidly attached to the spring to provide an even stronger assembly.

Accordingly, the spring assembly may be used in connection with protective equipment selected from the group consisting of helmets, shin guards, chest protectors, pads, and shields. As such, the spring assembly may be utilized for activities selected from the group consisting of football, hockey, baseball, softball, lacrosse, skiing, horseback riding, climbing, skateboarding, roller skating, cycling, motorcycling, automobile racing, snowmobiling, construction, police usage, firefighting usage, and military usage.

As noted above, the spring assembly may be retrofitted to previously-existing helmets and protective equipment. This will allow those who currently own relatively expensive protective gear to enjoy the benefits of the present invention at relatively low cost.

However, the spring assembly may be manufactured in connection with new helmets and protective equipment, allowing for a highly convenient solution to problems existing in the prior art.

For the purposes of example, the quantity of springs in the spring assembly may be of a range of two to fifty.

It is intended that the springs width be variable according to needs, such as of a width of a range of one-sixteenth inch to one half inch.

Similarly, it is intended that the flared insert width be variable according to needs, such as of a range of one-quarter inch to three quarter inch.

One area that greatly distinguishes the present invention from the prior art is that the assembly allows for springs to come in contact with all points of a user's head, tightly fitting the contour of the user's head.

It should also be noted that the spring assembly mitigates the incidence of cracking to the helmets and protective equipment.

Moreover, the spring assembly may be manufactured in a variety of previously determined sizes, functioning to render the spring assembly effective for multiple previously determined sporting events and hazardous activities.

In addition, the spring assembly may manufactured in a variety of previously determined colors and designs, functioning to match a décor of helmets and protective equipment upon which the spring assembly is utilized.

Furthermore, the spring assembly attaches to the helmets and protective equipment without significant modification to the helmets and protective equipment.

Finally, it bears repeating that the springs described herein may be retrofitted to previously-existing helmets, or alternatively may be manufactured in connection with new helmets, providing the utmost in versatility to those in need of protective headgear.

With regards to all descriptions and graphics, while the invention has been illustrated and described as embodied, it is not intended to be limited to the details shown, since it will be understood that various omissions, modifications, substitutions and changes in the forms and details of the device illustrated and in its operation can be made by those skilled in the art without departing in any way from the spirit of the invention.

Without further analysis, the foregoing will so fully reveal the gist of the present invention that others can readily adapt it for various applications without omitting features that, from the standpoint of prior art, constitute essential characteristics of the generic or specific aspects of this invention. What is claimed as new and desired to be protected by Letters Patent is set forth in the appended claims:

What is claimed is:

1. An impact and energy absorbing assembly for helmets and protective gear comprising:

at least one spring (12), which comprises a spring first end (12A) and spring second end (12B);

a first flared insert (14) affixed to spring (12) at the spring first end (12A), the flared insert (14) generally conical in configuration, tapered such that an outer edge of the first flared insert (14) is of a greater diameter than an inner edge of the first flared insert (14) which comes in contact with the spring first end (12A);

a second flared insert (16) affixed to spring (12) at the spring second end (12B), the flared insert (16) generally conical in configuration, tapered such that an outer edge of the second flared insert (16) is of a greater diameter than an inner edge of the second flared insert (16) which comes in contact with the spring second end (12B);

a receiving member (18), comprising a top surface (18A), bottom surface (18B), and molded female slot (20), molded female slot (20) in the form of a tapered, generally conical aperture, functioning to slidingly receive first flared insert (14) therein;

receiving member (18) rigidly affixed to a previously determined item of protective equipment, functioning to allow the spring to receive primary forces, with the item of protective equipment receiving secondary forces, previously existing protective equipment padding receiving additional forces, with only remaining dissipated forces distributed to a user's body.

2. The impact and energy absorbing assembly for helmets and protective gear as described in claim 1, the spring is tailored to absorb and dissipate foreseeable forces of humans and objects coming in contact with the impact and energy absorbing assembly for helmets and protective gear.

3. The impact and energy absorbing assembly for helmets and protective gear as described in claim 1, wherein the spring is manufactured of polymeric materials.

4. The impact and energy absorbing assembly for helmets and protective gear as described in claim 1, wherein the spring is manufactured of metal materials.

5. The impact and energy absorbing assembly for helmets and protective gear as described in claim 1, wherein the first flared insert and second flared insert are rigidly attached to the spring.

6. The impact and energy absorbing assembly for helmets and protective gear as described in claim 1, wherein the spring is manufactured of titanium.

7. The impact and energy absorbing assembly for helmets and protective gear as described in claim 1, wherein the impact and energy absorbing assembly for helmets and protective gear is use in connection with protective equipment selected from the group consisting of helmets, shin guards, chest protectors, pads, and shields.

8. The impact and energy absorbing assembly for helmets and protective gear as described in claim 1, wherein the impact and energy absorbing assembly for helmets and protective gear is retrofitted to previously-existing helmets protective equipment.

9. The impact and energy absorbing assembly for helmets and protective gear as described in claim 1, wherein the impact and energy absorbing assembly for helmets and protective gear is manufactured in connection with new helmets.

10. The impact and energy absorbing assembly for helmets and protective gear as described in claim 1, wherein a quantity of springs in the spring assembly is of a range of two to fifty.

11. The impact and energy absorbing assembly for helmets and protective gear as described in claim 1, wherein the spring is of a width of a range of one-sixteenth inch to one half inch.

12. The impact and energy absorbing assembly for helmets and protective gear as described in claim 1, wherein the flared insert is of a width of a range of one-quarter inch to three quarter inch.

13. The impact and energy absorbing assembly for helmets and protective gear as described in claim 1, wherein the assembly allows for springs to come in contact with all points of a user's head, tightly fitting the contour of the user's head.

14. The impact and energy absorbing assembly for helmets and protective gear as described in claim 1, wherein the impact and energy absorbing assembly for helmets and protective gear mitigates the incidence of cracking to the helmets and protective equipment.

15. The impact and energy absorbing assembly for helmets and protective gear as described in claim 1, wherein the impact and energy absorbing assembly for helmets and protective gear is manufactured in a variety of previously determined sizes, functioning to render the spring assembly effective for multiple previously determined sporting events and hazardous activities.

16. The impact and energy absorbing assembly for helmets and protective gear as described in claim 1, wherein the impact and energy absorbing assembly for helmets and protective gear is manufactured in a variety of previously determined colors and designs, functioning to match a décor of helmets and protective equipment upon which the spring assembly is utilized.

17. The impact and energy absorbing assembly for helmets and protective gear as described in claim 1, wherein the impact and energy absorbing assembly for helmets and protective gear attaches to the helmets and protective equipment without significant modification to the helmets and protective equipment.

18. The impact and energy absorbing assembly for helmets and protective gear as described in claim 1, wherein the impact and energy absorbing assembly for helmets and protective gear is utilized for activities selected from the group consisting of football, hockey, baseball, softball, lacrosse, skiing, horseback riding, climbing, skateboarding, roller skating, cycling, motorcycling, automobile racing, snowmobiling, construction, police usage, firefighting usage, and military usage.

* * * * *